US006518928B1

(12) United States Patent
Sheu

(10) Patent No.: US 6,518,928 B1
(45) Date of Patent: Feb. 11, 2003

(54) ANTENNA DEVICE HAVING A ROTATION LIMITED STRUCTURE

(76) Inventor: Jinn Fwu Sheu, No. 13, Alley 77, Lane 381, Jung Jeng South Road, Yung Kang City, Tainan Hsien, 710 (TW)

( * ) Notice: Subject to any disclaimer, the term of this patent is extended or adjusted under 35 U.S.C. 154(b) by 0 days.

(21) Appl. No.: 09/943,315

(22) Filed: Aug. 31, 2001

(51) Int. Cl.[7] ..... H01Q 1/24
(52) U.S. Cl. ..... 343/702; 343/906
(58) Field of Search ..... 343/702, 906, 343/880, 882; 455/90

(56) References Cited

U.S. PATENT DOCUMENTS 5,973,645 A * 10/1999 Zigler et al. ..... 343/702
6,317,085 B1 * 11/2001 Sandhu et al. ..... 343/702

* cited by examiner

*Primary Examiner*—Don Wong
*Assistant Examiner*—James Clinger
(74) *Attorney, Agent, or Firm*—Charles E. Baxley

(57) ABSTRACT

An antenna device includes a housing secured to an electric facility, a seat rotatably received in the housing, and an antenna element rotatably secured to the seat with a pivot pin. The housing includes a curved recess formed in the upper portion. The seat includes a projection extended radially outward and slidably engaged in the curved recess of the housing, for limiting the projection to slide along the curved recess of the housing and for limiting the rotational movement of the seat relative to the housing and for preventing electric wires from being twisted.

5 Claims, 5 Drawing Sheets

ANTENNA DEVICE HAVING A ROTATION LIMITED STRUCTURE

BACKGROUND OF THE INVENTION

1. Field of the Invention

The present invention relates to an antenna device, and more particularly to an antenna device having a rotation limited structure for preventing the electric wire from being over twisted or distorted.

2. Description of the Prior Art

Typical antenna devices, such as the broadband wireless and tunable antenna devices may be attached to the radio and/or video facilities, the moving vehicles, the portable phones, or the game facilities that may be coupled to the net works with the cable modem devices, or the like. The typical antenna devices normally includes a radiating element rotatably secured to a housing or a support with a pivotal or rotatable joint or the like, for allowing the radiating element to be rotated freely relative to the support or the housing to any suitable direction. The radiating element is normally coupled to the electric devices with electric wires. However, the typical antenna devices have no rotation limited structure for preventing the electric wire from being over twisted or distorted, such that the electric wire may be easily twisted or damaged, or even broken.

The present invention has arisen to mitigate and/or obviate the afore-described disadvantages of the conventional antenna devices.

SUMMARY OF THE INVENTION

The primary objective of the present invention is to provide an antenna device including a rotation limited structure for preventing the electric wire from being over twisted or distorted.

In accordance with one aspect of the invention, there is provided an antenna device comprising a housing including a bore formed therein, a seat rotatably received in the bore of the housing, an antenna element rotatably secured to the seat with a pivot pin, and means for limiting a rotational movement of the seat relative to the housing.

The rotational movement limiting means includes a curved recess formed in the housing, and a projection extended from the seat and slidably engaged in the curved recess of the housing, for limiting the projection to slide along and within the curved recess of the housing.

The seat includes at least one spring leg having a peripheral rib extended radially outward therefrom for engaging with the housing and for rotatably securing the seat to the housing.

A plate is further provided and includes an orifice formed therein for receiving the housing, and means for securing the housing to the plate.

The plate includes an upper portion and a lower portion, the housing includes an upper portion, the securing means includes a peripheral flange extended from the upper portion of the housing and engaged with the upper portion of the plate, and includes at least one latch extended from the housing and engaged with the lower portion of the plate for securing the housing to the plate.

The housing includes a peripheral portion having at least one opening formed therein, and having the at least one latch extended inward of the at least one opening thereof and extended outward of the housing for engaging with the plate.

The orifice of the plate includes a non-circular cross section, the housing includes a non-circular cross section corresponding to that of the orifice of the plate for stably engaging in the orifice of the plate and for preventing the housing from rotating relative to the plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
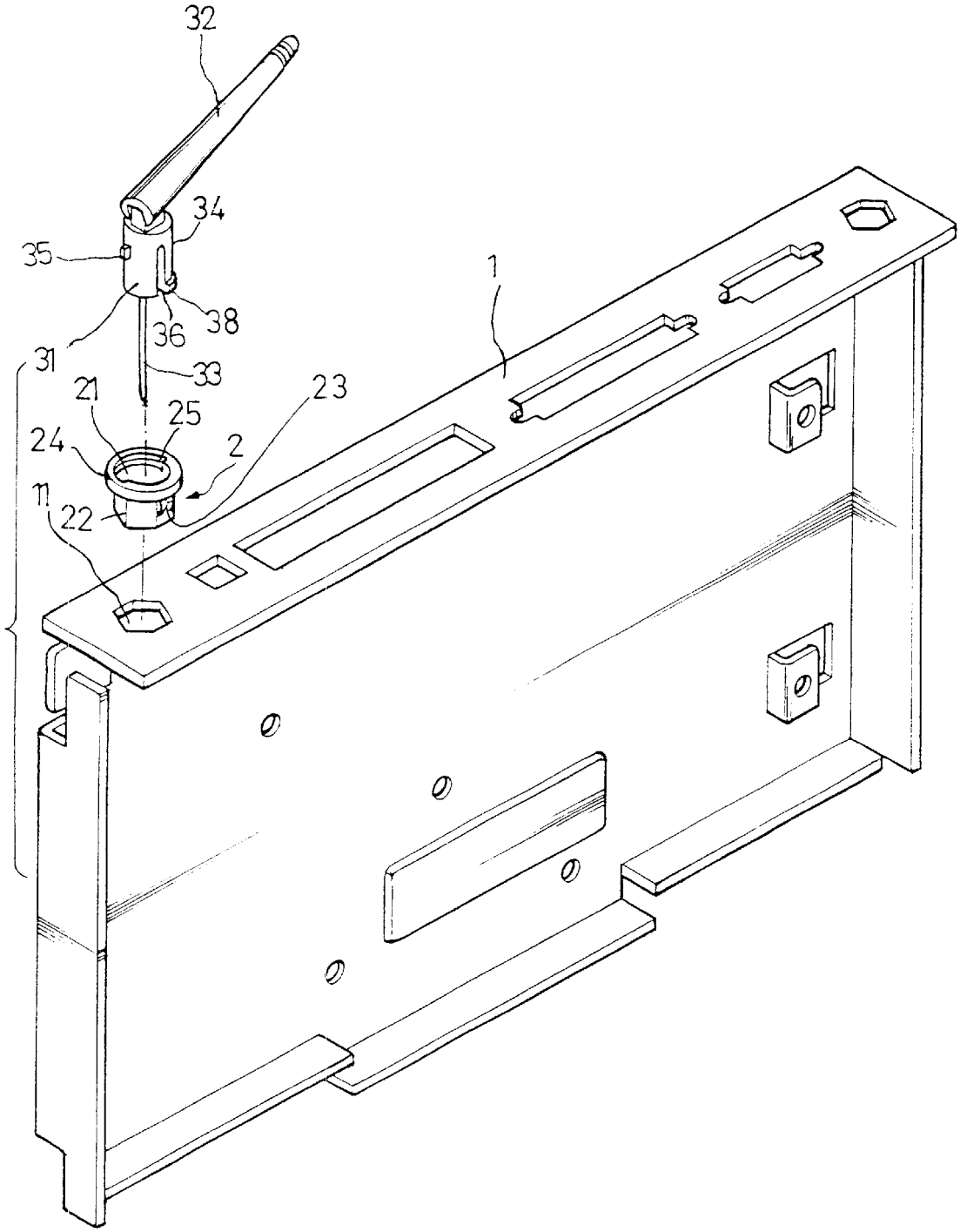
FIG. 1 is an exploded view of an antenna device in accordance with the present invention.
Figure 2:
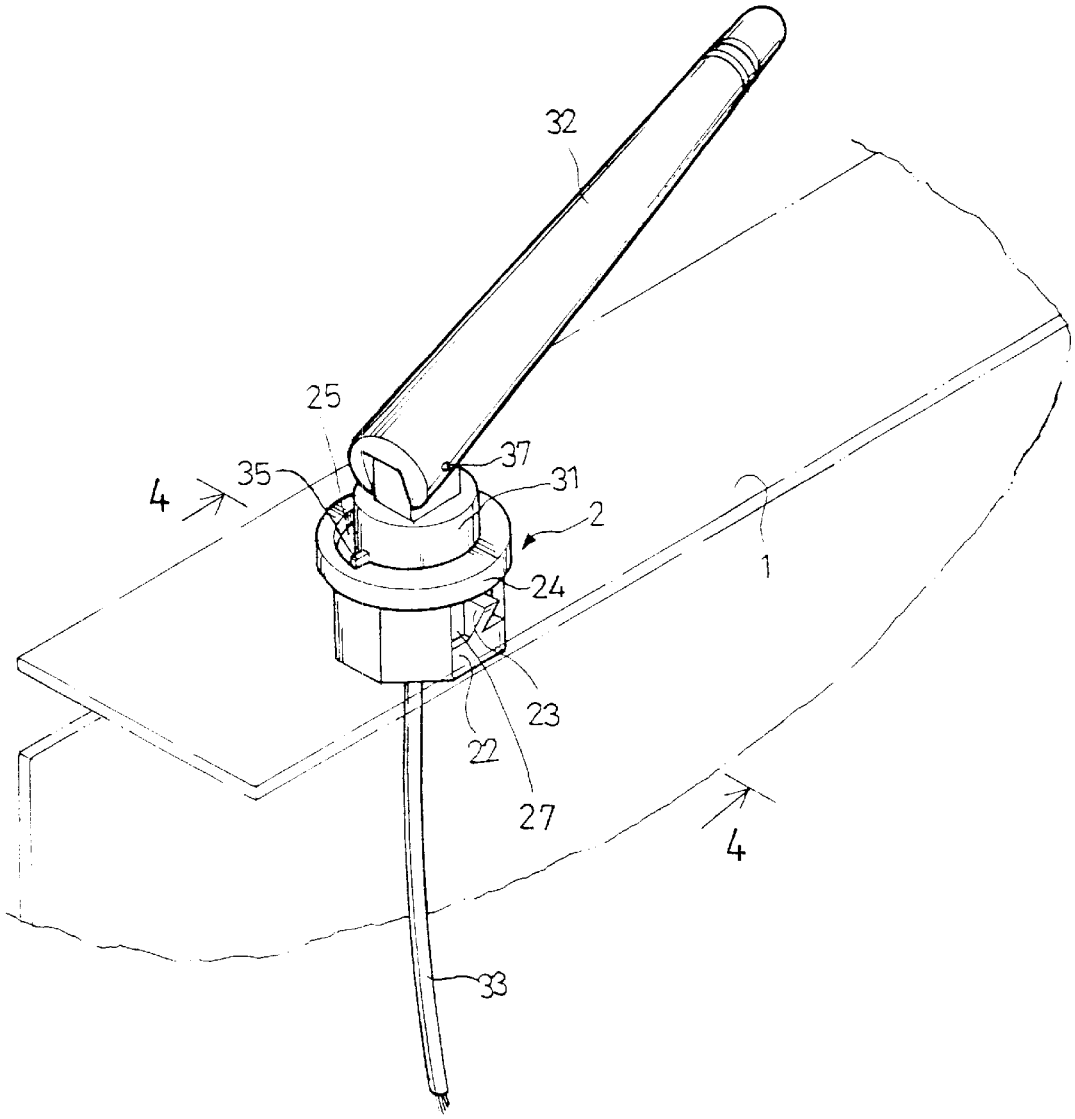
FIG. 2 is a perspective view of the antenna device.
Figure 3:
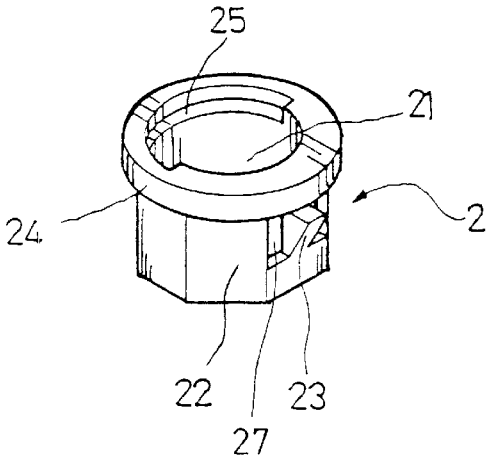
FIG. 3 is a perspective view illustrating a housing for the antenna device.
Figure 4:
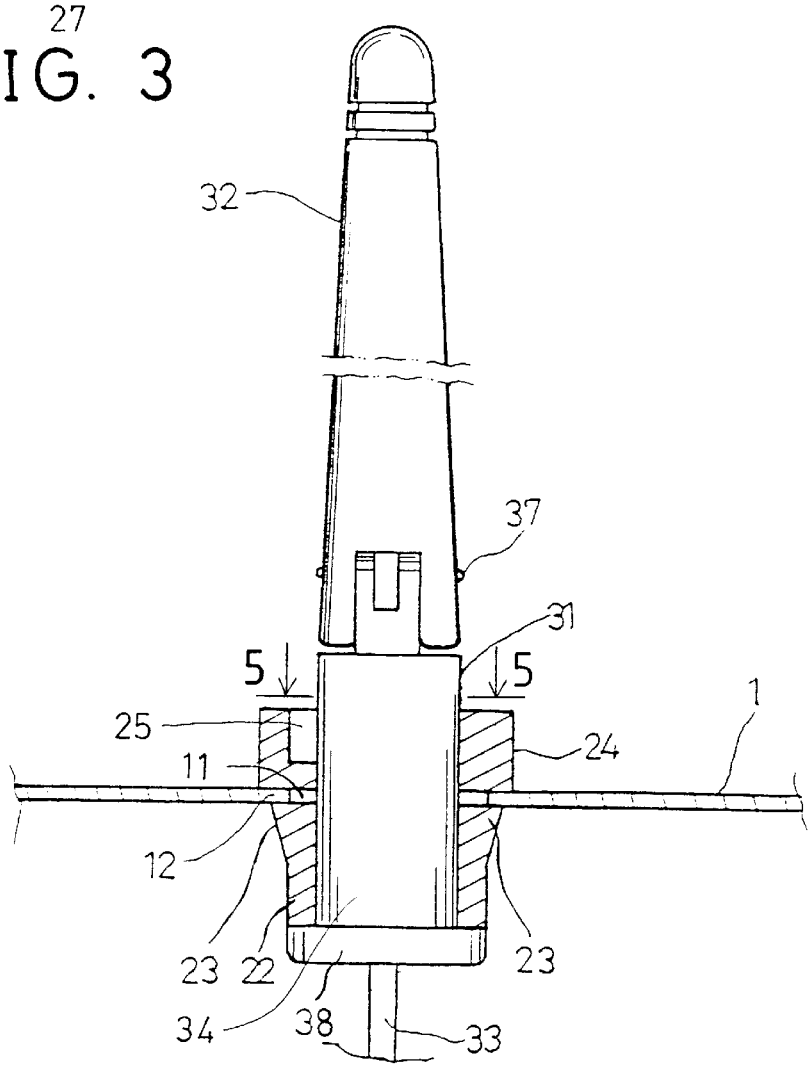
FIG. 4 is a cross sectional view taken along lines 4—4 of FIG. 2.

Referring to the drawings, and initially to FIGS. 1–4, an antenna device in accordance with the present invention comprises a support or a housing or a plate 1 including a non-circular orifice 11 formed therein, such as a hexagonal orifice 11 formed therein. A housing 2 includes an outer peripheral surface 22 having a cross section equals to or corresponding to that of the orifice 11 of the plate 1, for allowing the housing 2 to be snugly fitted or engaged within the orifice 11 of the plate 1, and for preventing the housing 2 from rotating relative to the plate 1. The housing 2 includes an upper portion having a peripheral flange 24 extended radially outward therefrom for engaging with the plate 1, such as the upper portion of the plate 1, and for allowing the housing 2 to be secured to the plate 1. The housing 2 includes a bore 21 formed therein, and includes one or more openings 27 formed in the peripheral portion thereof, and one or more spring-biased or resilient wedges or latches 23 extended inward of the openings 27 and extended outward of the housing 2 for engaging with the lower portion of the plate 1 (FIG. 4) and for solidly securing the housing 2 to the plate 1. The housing 2 includes a curved recess 25 formed in the upper portion thereof and extended for about one half of the upper peripheral portion of the housing 2.

An antenna element 32 includes one end, such as the lower end thereof pivotally or rotatably secured to an upper portion of a seat 31 with such as a pivot pin 37, for allowing the antenna element 32 to be rotated relative to the seat 31 about the pivot pin 37. The seat 31 is rotatably engaged in the bore 21 of the housing 2, and includes one or more grooves 36 formed therein for forming or defining one or more spring legs 34, and includes one or more peripheral ribs 38 extended radially outward from one or more of the spring legs 34, particularly extended radially outward from the bottom portions of the spring legs 34, for engaging with the housing 2 (FIG. 4) and for rotatably securing the seat 31 to the housing 2. The seat 31 further includes a projection 35 extended radially outward therefrom for slidably engaging in the curved recess 25 of the housing 2. The antenna element 32 and/or the seat 31 is electrically coupled, with one or more electric wires 33, to the electric devices (not shown) that are provided in or attached to the plate 1.

Figure 5:
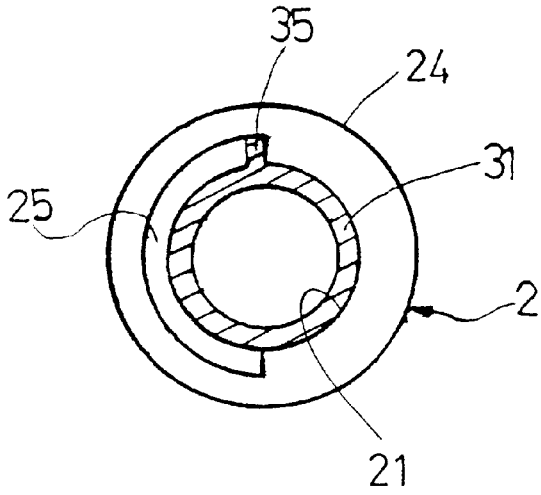
FIG. 5 is a cross sectional view taken along lines 5—5 of FIG. 4.
Figure 6:
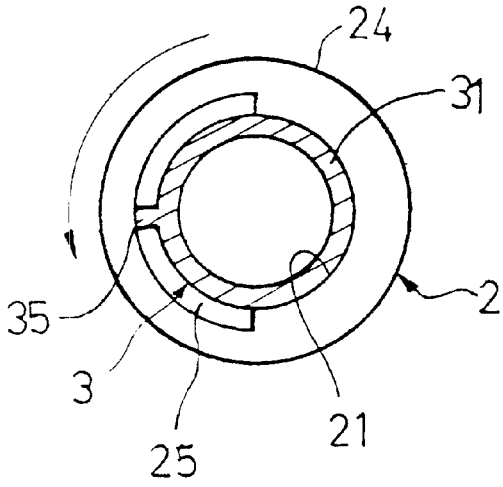
FIG. 6 is a cross sectional view similar to FIG. 5, showing the operation of the antenna device.
Figure 7:
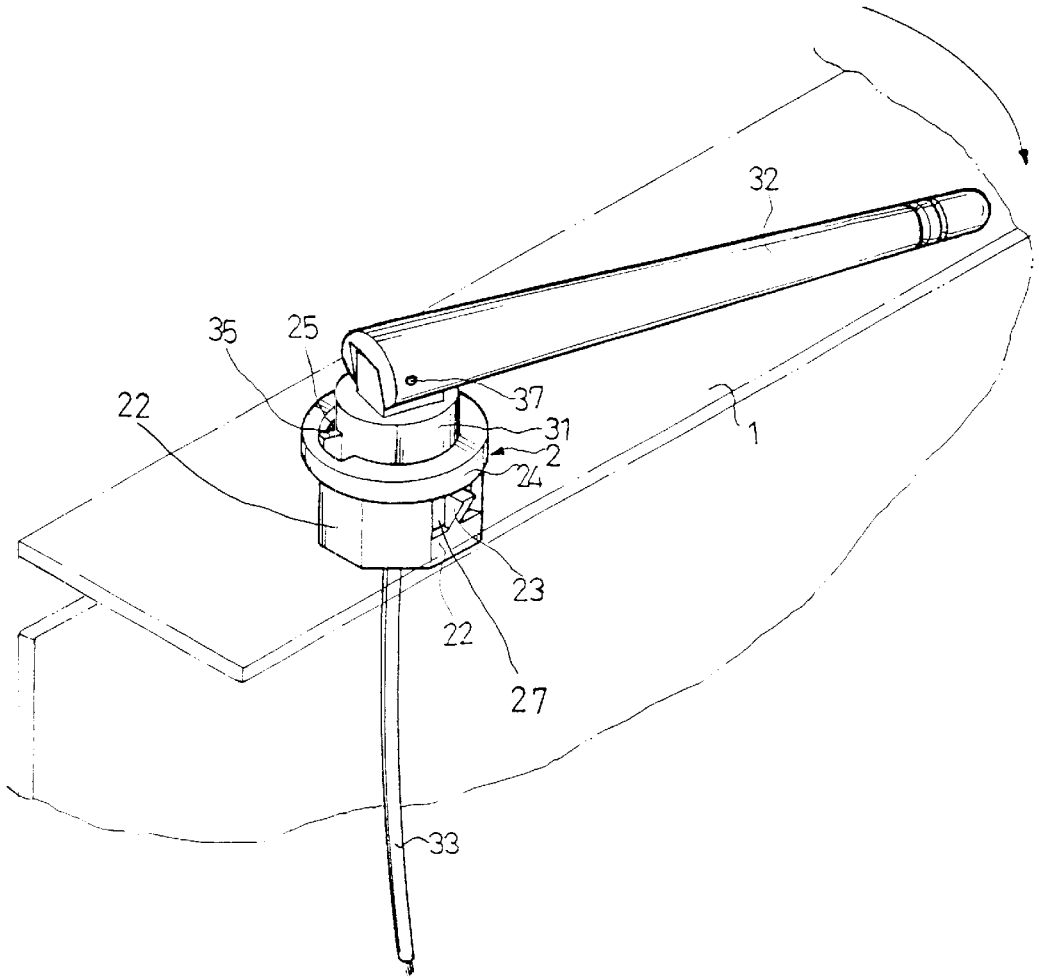
FIG. 7 is a perspective view similar to FIG. 2, illustrating the operation of the antenna device.

In operation, as shown in FIGS. 2 and 5–7, the projection 35 of the seat 31 is slidably engaged in the curved recess 25 of the housing 2, is thus limited to slide within the curved recess 25 of the housing 2, in order to limit the rotation of the seat 31 relative to the housing 2. The antenna element 32 may thus be rotated relative to the seat 31 about the pivot pin 37, and the seat 31 may be rotated relative to the housing 2 in a limited rotational movement, such that the electric wire 33 may be prevented from being twisted or distorted and may thus be prevented from being broken after use.

Accordingly, the antenna device in accordance with the present invention includes a rotation limited structure for preventing the electric wire from being over twisted or distorted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna device comprising:

a housing including a bore formed therein, a seat rotatably received in said bore of said housing, an antenna element rotatably secured to said seat with a pivot pin, means for limiting a rotational movement of said seat relative to said housing, a plate including an orifice formed therein for receiving said housing, said orifice of said plate including a non-circular cross section, and means for securing said housing to said plate, said housing including a non-circular cross section corresponding to that of said orifice of said plate for stably engaging in said orifice of said plate and for preventing said housing from rotating relative to said plate.

2. The antenna device according to claim 1, wherein said rotational movement limiting means includes a curved recess formed in said housing, and a projection extended from said seat and slidably engaged in said curved recess of said housing, for limiting said projection to slide along and within said curved recess of said housing.

3. The antenna device according to claim 1, wherein said seat includes at least one spring leg having a peripheral rib extended radially outward therefrom for engaging with said housing and for rotatably securing said seat to said housing.

4. An antenna device comprising:

a housing including a bore formed therein, and including an upper portion, a seat rotatably received in said bore of said housing, an antenna element rotatably secured to said seat with a pivot pin, means for limiting a rotational movement of said seat relative to said housing, a plate including an orifice formed therein for receiving said housing, said plate including an upper portion and a lower portion, and means for securing said housing to said plate, said securing means including a peripheral flange extended from said upper portion of said housing and engaged with said upper portion of said plate, and including at least one latch extended from said housing and engaged with said lower portion of said plate for securing said housing to said plate.

5. The antenna device according to claim 4, wherein said housing includes a peripheral portion having at least one opening formed therein, and having said at least one latch extended inward of said at least one opening thereof and extended outward of said housing for engaging with said plate.

* * * * *